US005288010A

United States Patent [19]

Kleemola et al.

[11] Patent Number: 5,288,010

[45] Date of Patent: Feb. 22, 1994

[54] PACKAGE

[75] Inventors: Pertti Kleemola; Ensio Mykkänen, both of Valkeakoski, Finland

[73] Assignee: Yhtyneet Paperitehtaat Oy, Valkeakoski, Finland

[21] Appl. No.: 730,788

[22] PCT Filed: Feb. 5, 1990

[86] PCT No.: PCT/FI90/00036

§ 371 Date: Jul. 24, 1991

§ 102(e) Date: Jul. 24, 1991

[87] PCT Pub. No.: WO90/09322

PCT Pub. Date: Aug. 23, 1990

[30] Foreign Application Priority Data

Feb. 7, 1989 [FI] Finland ..... 890578

[51] Int. Cl.[5] ..... B65D 3/14

[52] U.S. Cl. ..... 229/5.5; 220/615; 220/620

[58] Field of Search ..... 229/5.5, 1.5 B, 5.8, 229/67, 93; 220/620, 612, 624, 614, 615

[56] References Cited

U.S. PATENT DOCUMENTS

| | | | |
|---|---|---|---|
| 146,150 | 1/1874 | Tenney | 220/620 |
| 1,134,730 | 4/1915 | Draper | 220/616 |
| 1,325,231 | 12/1919 | Cochrane | 220/616 X |
| 1,597,890 | 8/1926 | Hulbert . | |
| 2,074,899 | 3/1937 | Gazette | 229/5.5 |
| 3,322,318 | 5/1967 | Felton, Jr. et al. | 229/5.5 |
| 3,472,417 | 10/1969 | Fox | 220/617 |
| 3,949,927 | 4/1976 | Smith et al. | 229/5.5 |
| 4,117,971 | 10/1978 | Itoh | 220/620 |
| 4,182,461 | 1/1980 | Waldau . | |
| 4,241,844 | 12/1980 | Dolveck | 220/620 |
| 4,597,502 | 7/1986 | Troughton | 220/617 |
| 4,836,400 | 6/1989 | Chaffey et al. | 220/612 |
| 4,975,132 | 12/1990 | Thompson | 220/620 |

FOREIGN PATENT DOCUMENTS

| | | | |
|---|---|---|---|
| 109424 | 4/1968 | Denmark | 220/612 |
| 22593 | 1/1981 | European Pat. Off. . | |
| 0022593 | 1/1981 | European Pat. Off. . | |
| 646720 | 10/1962 | Italy | 220/612 |
| 445331 | 6/1986 | Sweden . | |

*Primary Examiner*—Allan N. Shoap
*Assistant Examiner*—Christopher McDonald
*Attorney, Agent, or Firm*—Young & Thompson

[57] ABSTRACT

A package comprising a substantially cylindrical body part consisting mainly of cardboard and having reversely folded end portions at both ends of the body part. Substantially round closing parts consisting mainly of cardboard are provided at both ends of the body part. Each of the closing parts has an edge portion turned substantially perpendicular to the plane of the closing part and attached to the respective end of the body part by passing it within the end of the body part. The edge portion of each closing part underlies a reversely folded end portion of the body part. A closing ring comprises a bead inserted between each end portion of the body part and the adjacent closing part. The bead has, on the side of the closing part, a convexly rounded surface mating with a concavely curved surface of the adjacent closing part.

5 Claims, 1 Drawing Sheet

PACKAGE

This invention relates to a package comprising a substantially cylindrical body part consisting mainly of cardboard; a substantially round closing part consisting mainly of cardboard at both ends of the body part, the closing part being attached to the end of the body part by passing it within the end of the body part while an edge portion in the closing part, turned substantially perpendicular to the plane of the closing part, projects away from the body part and by turning an end portion of the body part over the edge portion of the closing part; and a closing ring fitted within the end of the body part.

Packages having at least one end manufactured as described above have previously been used only for the packing of dry substances, such as spices and baking powder. When the package is made of a liquid packing cardboard, such as plastic laminated cardboard, the closing parts can be heat sealed to the body part when the end portions of the body part are turned over the edge portions of the closing parts. In this way the package becomes liquid-tight. However, the poor strength of the joint of the closing parts makes this package unsuitable for use with more or less pressurized liquids. Nor does the prior art disclose any other packages consisting mainly of cardboard for pressurized liquids, not even with pressures as low as a few bars.

The object of the present invention is to provide a cylindrical package of the type described above to achieve a package for liquids, particularly for liquids containing components, such as carbon dioxide, which create a low pressure within the package.

The package of the invention is characterized in that the closing ring comprises a bead which is arranged to be inserted between the end portion of the body part and the closing part and which comprises on the side of the closing part a surface the normal of which intersects the longitudinal axis of the body part.

The rounded surface of the bead of the closing ring causes the pressure prevailing inside the package and tending to open the seam between the closing part and the body part to press the closing ring outward more and more tightly against the turned edge portions of the closing parts and the body part, thus strengthening the joint between the closing parts and the body part. On the other hand, the position of the bead under the turned end portion of the body part ensures that the closing ring stays in place especially when it is attached by heat sealing, e.g., to both the closing part and the end portion of the body part. Once fitted within the ends of the body part the closing ring cannot thus any longer be removed without breaking the package.

The bead of the closing ring is preferably inserted between the closing part and the end surface of the end portion.

In the following the package according to the invention and its operation will be described in greater detail with reference to the attached drawing, wherein FIG. 1 is a cross-sectional view of one end of a package according to a first embodiment of the invention;

Figure 1:
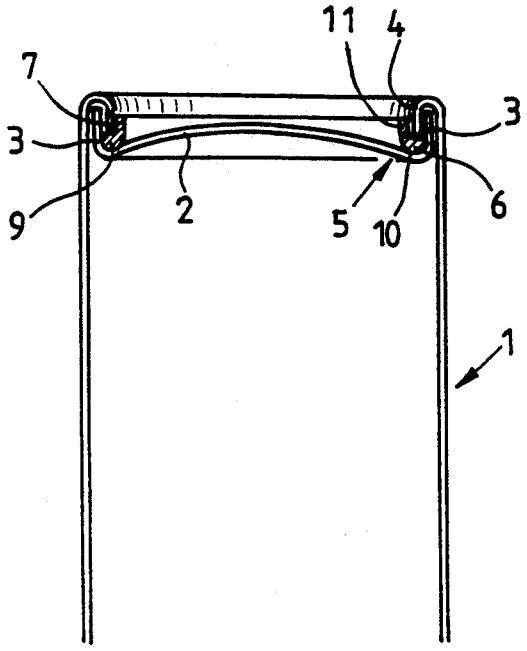

FIG. 1 shows a cross-sectional view of one end of a package according to the first embodiment of the invention. The package comprises a substantially cylindrical body part 1 and a substantially round closing part 2 attached to the end of the body part. The substantially cylindrical shape is to be preferred because the pressure acting on the joint between the body part and the closing part from within the package is thereby distributed evenly over the whole length of the joint. The cylindrical shape of the body part 1 can be achieved, e.g., by bending a straight sheet into a cylinder and by fastening the overlapping edges together by heat sealing, for instance. The joint can be made sufficiently strong by overlapping the edges sufficiently. Both the body part 1 and the closing part 2 consist mainly of cardboard, e.g., liquid packing cardboard, such as plastic laminated cardboard, comprising a thin plastic layer on both outer surfaces, between which layers a layer of cardboard and possibly an aluminium layer a few micrometers in thickness are provided.

The closing part 2 is attached to the end of the body part 1 by first passing it within the end of the body part 1 with the edge portions 3 of the closing part 2 turned substantially perpendicular to the plane of the closing part so that they extend away from the body part 1. Thereafter the end portions 4 of the body part 1 are turned over the edge portions 3 of the closing part 2. The end portions 4 of the body part 1 and the edge portions 3 of the closing part 2 are heat sealed together, whereby both surfaces of the edge portions 3 of the closing part 2 are attached to the body part. The joint so formed is tight. When a more or less pressurized material is packed in the body part, the pressure, however, tends to force the closing parts outward with the result that even a very low pressure may open the joints. This is due to the poor strength of the heat-sealed joint and particularly to the poor rigidity of the manufacturing material of the body part and the closing parts of the package. To overcome this problem, a closing ring 5 comprising a bead 9 is fitted within the end portion of the body part 1 in such a way that the bead is inserted between the end portion 4 of the body part 1 and the closing part 2. On the side of the closing part 2 the bead comprises a surface 10 the normal of which intersects the longitudinal axis of the body part 1. By suitably dimensioning the closing ring the strength of the joint between the body part 1 and the closing part 2 can be increased so that it withstands a pressure of at least about 3 to 3.5 bar. The operation of this closing ring is based on its position, shape and rigidity properties. The closing ring 5 can be made of various injection moulding plastics, such as LDPE, HDPE or PP.

Figure 2:
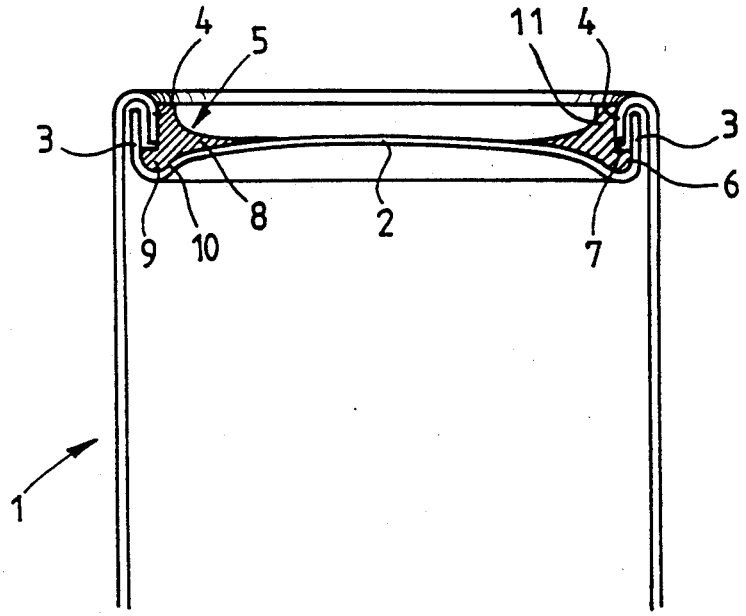
FIG. 2 is a cross-sectional view of one end of a package according to a second embodiment of the invention.

The closing ring 5 can be fastened within the ends of the body part 1 by gluing or heat sealing, for instance. FIGS. 1 and 2, however, show a third way of fastening which is perhaps the simplest one but nevertheless extremely reliable. In the figures, an annular projection 6 is provided on the outer periphery of the bead 9 of the closing ring 5. The projection is inserted between the closing part 2 and an end surface 7 in the end portions 4 of the body part 1. When the closing ring 5 is pressed in position from the direction of the end of the body part 1, the projection 6 is inserted into a gap left between said end surface 7 and the closing part 2, whereby the closing ring is locked in position very reliably. In this way the closing ring 5 also efficiently supports the closing part 2 at its outer periphery, thus efficiently resisting the tendency of the pressure prevailing inside the pack to tear open the joint. The closing ring 5 also forces the closing part 2 to keep its original shape at places where the edge portions 3 of the closing part are turned substantially perpendicular to the middle portion of the closing part 2.

For efficient operation of the closing ring of the invention it is also important that the bead 9 with a roundish edge provided in the ring 5 on the side of the closing part 2 comprises a surface 10 the normal of which intersects the longitudinal axis of the body part 1. The operation of the surface 10 can be improved by shaping the closing part 2 in a corresponding way at its performing step. The surface causes the pressure prevailing within the package to press the closing part 2 outward against the body part 1, thus strengthening the joint between the closing part and the body part. On the other hand, the round shape of the surface 10 prevents the closing part 2 from being cut open at the inner edge of the closing ring when the pressure prevailing inside the package tends to force the middle portion of the closing part outward and thus against the inner edge of the closing ring.

The closing ring 5 of the embodiment shown in FIG. 1 further comprises an annular section 11 adjoining the bead 9. The annular section 11 comprises a substantially cylindrical outer surface arranged to be pressed against that surface portion of the turned end portion 4 of the body part 1 which extends in the direction of the central axis of the package.

FIG. 2 shows a second embodiment of the package of the invention. In corresponds to a very great extent to the embodiment shown in FIG. 1, the same structural parts being indicated with the same reference numerals as in FIG. 1. The embodiment of FIG. 2 differs from that of FIG. 1 only in that the closing ring 5 comprises an annular projection or tongue 8 also on its inner periphery, the projection or tongue comprising a surface arranged to be pressed against the closing part 2. By means of the surface of the tongue 8 the pressure prevailing within the package and tending to force the closing part outward can be turned so that it simultaneously presses the closing ring 5 and particularly its section 11 more closely against the end portions 4 of the body part 1.

Figure 3:
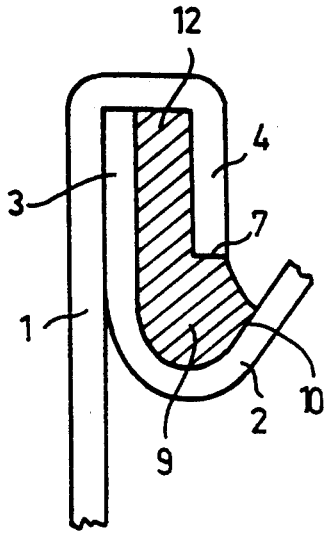
FIG. 3 is a cross-sectional view of a package according to a third embodiment of the invention at the joint between the body part and the closing part.
Figure 4:
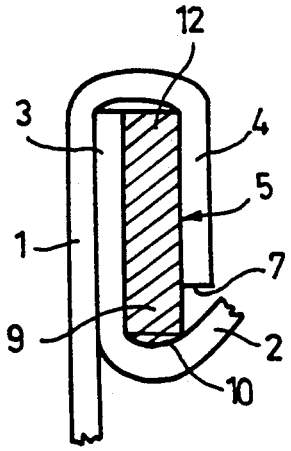
FIG. 4 is a cross-sectional view of a package according to a fourth embodiment of the invention at the joint between the body part and the closing part.

FIGS. 3 and 4 show two further embodiments of the invention, in which the annular section of the bead 9, comprising a substantially cylindrical outer surface, is, as distinct from the embodiments of FIGS. 1 and 2, disposed between the turned end portion 4 of the body part and the turned edge portion 3 of the closing part 2. The section is indicated with the reference numeral 12. In other respects these embodiments corresponds to those of FIGS. 1 and 2, the same or corresponding parts being indicated with the same reference numerals as in these figures. In the embodiment of FIG. 3, the bead 9 of the closing ring 5 also comprises a section which is inserted between the closing part 2 and the end surface 7 of the end portion 4 of the body part 1. The closing ring of the embodiment of FIG. 4 does not comprise this kind of section, but the bead 9 is formed only by a rounded edge of a ring having a substantially rectangular cross-section, the surface 10 of the rounded edge being pressed against the closing part 2.

It is possible to reliably package liquids and soft drinks creating a pressure of up to 2.5 bar in packages according to the embodiments of the invention shown in FIGS. 1 to 4. Thereby the package has to resist pressures of up to 3.5 bar in tests.

The package of the invention has been described above only by way of example by means of a few specific embodiments, and it is to be understood that the embodiments described can be modified in various ways without deviating from the scope of protection defined in the attached claims. So the way of fastening and the shape of the closing ring in particular can differ from those described above. It is also possible to provide the closing ring with one or more support chord extending over the closing part 2, especially if the closing ring as such is not able to provide a rigidity sufficient for ensuring reliable operation. Thus, it will be seen that the present invention provides a package comprising a substantially cylindrical body part consisting mainly of cardboard and having reversely folded end portions at both ends the body part; substantially round closing parts consisting mainly of cardboard at both ends of the body part, each of the closing parts having an edge portion turned substantially perpendicular to the plane of the closing part and being attached to the respective end of the body part by passing it within the end of the body part, said edge portion of each closing part underlying a said reversely folded end portion of said body part; and a closing ring comprising a bead inserted between each end portion of the body part and the adjacent closing part, the bead comprising on the side of the closing part a convexly rounded surface mating with a concavely curved surface of said adjacent closing part. The package can have an annular tongue of the inner periphery of the closing ring, said annular tongue comprising a surface arranged pressing against the closing part. The closing ring can further comprise an annular section adjoining the bead, said annular section comprising a substantially cylindrical outer surface pressing against a substantially cylindrical inner surface on the adjacent said reversely folded end portion of the body part.

We claim:

1. A package comprising a substantially cylindrical body part consisting essentially of cardboard and having reversely folded end portions at both ends of said body part; substantially round closing parts consisting mainly of cardboard at both ends of the body part, each of the closing parts having an edge portion turned in a direction away from a central portion of said package substantially perpendicular to the plane of the closing part and being attached to the respective end of the body part by passing it within the end of the body part, said edge portion of each closing part underlying a said reversely folded end portion of said body part; and a closing ring comprising a bead inserted between each end portion of the body part and the adjacent closing part, the bead comprising a convexly rounded surface mating with a concavely curved surface of said adjacent closing part which is located at a junction between said edge portion and a central portion of said adjacent closing part.

2. A package according to claim 1, further comprising an annular tongue on the inner periphery of the closing ring, said annular tongue comprising a surface arranged pressing against the closing part.

3. A package according to claim 1, the closing ring further comprising an annular section adjoining the bead, said annular section comprising a substantially cylindrical radially outer surface pressing against a substantially cylindrically radially inner surface on the adjacent said reversely folded end portion of the body part.

4. A package comprising a substantially cylindrical body part consisting essentially of cardboard and having radially inwardly reversely folded end portions at both ends of said body part; substantially round closing parts consisting essentially of cardboard at both ends of the body part, each of the closing parts having an edge portion turned substantially perpendicular to the plane of the closing part and being attached to the respective end of the body part by passing it within the end of the body part, said edge portion of each closing part underlying a said radially inwardly reversely folded end portion of said body part; and a closing ring sealing between each said end portion of the body part and the adjacent closing part and having a portion disposed in alignment with the adjacent said end portion of the body part in a direction parallel to the axis of said cylindrical body part, further comprising an annular tongue on the inner periphery of the closing ring, said annular tongue comprising a surface arranged pressing against the closing part.

5. A package according to claim 4, the closing ring further comprising an annular section comprising a substantially cylindrical radially outer surface pressing against a substantially cylindrical radially inner surface on the adjacent said reversely folded end portion of the body part.

* * * * *